US005897806A

United States Patent [19]

Watanabe

[11] Patent Number: 5,897,806

[45] Date of Patent: Apr. 27, 1999

[54] ADAPTOR DEVICE FOR CONNECTING SHEATHED HEATER WITH POWER SUPPLY TERMINAL

[75] Inventor: Toru Watanabe, Tokyo, Japan

[73] Assignee: Sakaguchi Dennetsu Kabushiki Kaisha, Tokyo, Japan

[21] Appl. No.: 08/935,125

[22] Filed: Sep. 22, 1997

[30] Foreign Application Priority Data

Sep. 26, 1996 [JP] Japan ..... 8-273977

[51] Int. Cl.[6] ..... H05B 3/08

[52] U.S. Cl. ..... 219/541; 219/544; 219/546; 219/548; 219/549

[58] Field of Search ..... 219/541, 544, 219/546, 548, 549; 439/469, 95

[56] References Cited

U.S. PATENT DOCUMENTS

| | | | |
|---|---|---|---|
| 2,639,359 | 5/1953 | Glenn | 219/528 |
| 4,551,619 | 11/1985 | Lefebvre | 219/523 |
| 5,449,861 | 9/1995 | Fujino et al. | 174/113 A |

*Primary Examiner*—Teresa Walberg
*Assistant Examiner*—Vinod D. Patel
*Attorney, Agent, or Firm*—Nilles & Nilles

[57] ABSTRACT

An adaptor device for connecting a sheathed heater with a power supply terminal wherein an end of a heater wire of the sheathed heater and an end of a lead wire are inserted into an adaptor sleeve and the ends of the heater wire and the lead wire in the adaptor sleeve are connected by a flexible wire. The flexible wire is a stranded wire or in the form of a wave.

1 Claim, 3 Drawing Sheets

ADAPTOR DEVICE FOR CONNECTING SHEATHED HEATER WITH POWER SUPPLY TERMINAL

BACKGROUND OF THE INVENTION

1. Field of the Invention

The present invention relates to an adaptor device for connecting a sheathed heater with a power supply terminal, and more particularly to an improvement of an adaptor device for connecting a heater wire of a sheathed heater such as a cable heater with a power supply lead wire, wherein the heater wire of the cable heater in the adaptor device is prevented from being broken.

2 . Description of the Prior Art

FIG. 1 shows a conventional adaptor device 2 for connecting an end of a heater wire 3 of a sheathed heater 1 of not greater than 7mm in outer diameter, for example, with an end of a lead wire 4 of a power supply, The end of the heater wire 3 is directly connected by welding with the end of the lead wire 4 in the adaptor device 2.

A reference numeral 6 denotes an insulating tube into which the ends of the heater wire 3 and the lead wire 4 are inserted, and a reference numeral 7 denotes a sleeve surrounding the insulating tube 6. A reference numeral 8 is an insulating powder material filled in the insulating tube 6 and the sleeve 7, 9 denotes a hermetically seal at each end of the sleeve 7, and 10 denotes a sheath of the sheathed heater 1. FIG. 2 shows a portion of the other conventional adaptor device 2, wherein the heater wire 3 is connected by a cylindrical intermediate terminal having a small inner diameter portion and a large inner diameter portion with the lead wire 4.

In such conventional adaptor devices, however, the heater wire 3 is liable to be broken in the adaptor device because the stress applied on the tip end of the heater wire 3 is increased due to the differences between the sleeve 7 of the adaptor device 2 and the lead wire 4 in the rate of thermal expansion. For example, if the sleeve 7 is larger in the rate of thermal expansion than the lead wire 4, an extendible force is applied on the tip end of the heater wire 3, whereas on the sleeve 7 is smaller in the rate of thermal expansion than the lead wire 4, a compressive force is applied on the tip end of the heater wire 3.

SUMMARY OF THE INVENTION

An object of the present invention is to obviate the above defects.

Another object of the present invention is to obtain an adaptor device for connecting a sheathed heater with a power supply terminal comprising an adaptor sleeve into which an end of a heater wire of the sheathed heater and an end of a lead wire of the power supply terminal are inserted, and a flexible wire for connecting the ends of the heater wire and the lead wire in the adaptor sleeve.

Further object of the present invention is to provide the adaptor device, wherein the flexible wire is a stranded wire.

The other object of the present invention is to provide the adaptor device, wherein the stranded wire is in the form of a wave.

The above and other objects as well as advantageous features of the present invention will become apparent form a consideration of the following description of the preferred embodiments taken in conjunction with the appended claims, and accompanying drawings.

DESCRIPTION OF THE PREFERRED EMBODIMENTS

Embodiments of the present invention will be explained with reference to FIGS. 3 and 4.

Figure 3:
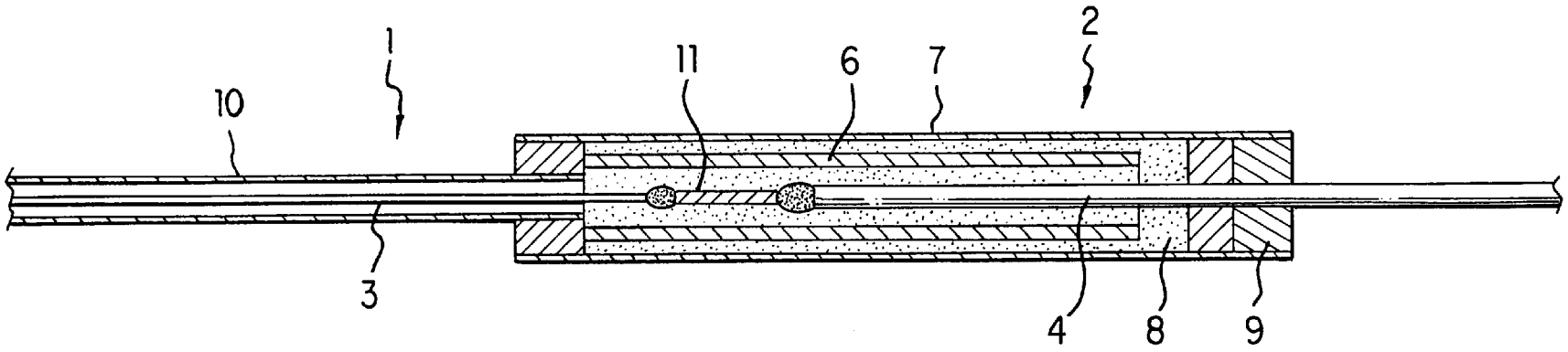
FIG. 3 Is a sectional view of an adaptor device according to the present invention.

In an embodiment of an adaptor device of the present invention, as shown in FIG. 3, an end of a heater wire 3 of the sheathed heater 1 and an end of a lead wire 4 of a power supply terminal are connected by a flexible wire 11 such as a stranded wire.

Figure 1:
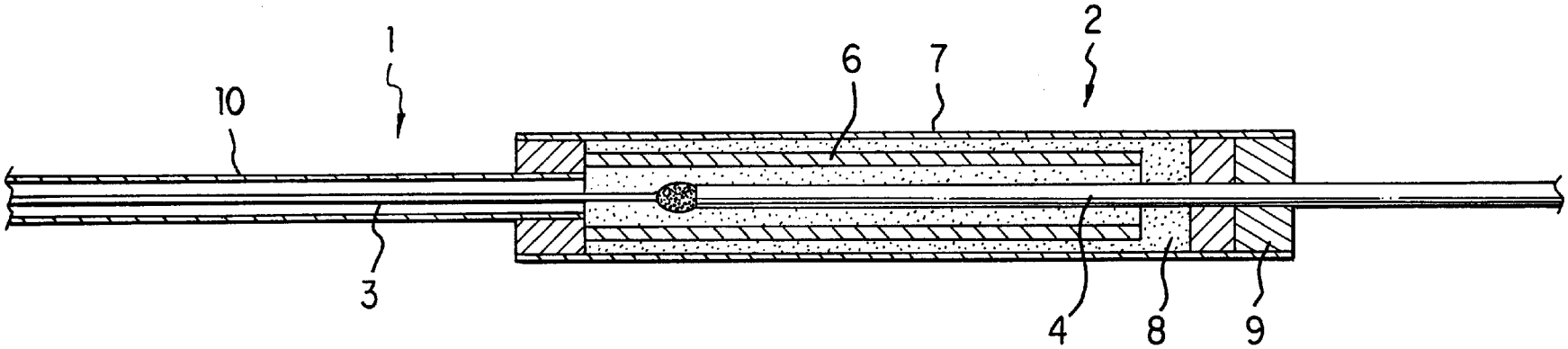
FIG. 1 PRIOR ART
FIG. 1 is a sectional view of a conventional adaptor device.
Figure 2:
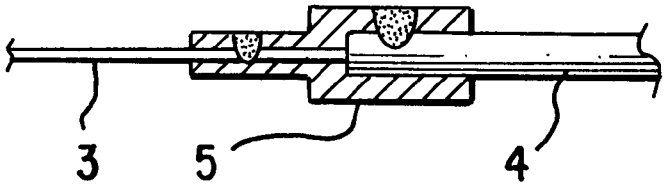
FIG. 2 PRIOR ART
FIG. 2 is a sectional view of a portion of the other conventional adaptor device.
Figure 4:
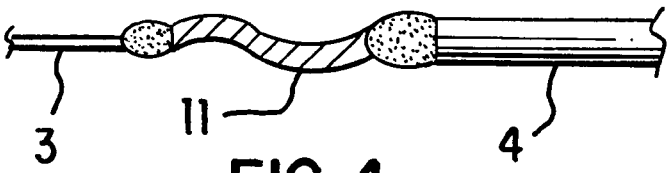
FIG. 4 is a sectional view of a portion of an adaptor device according to another embodiment of the present invention.

In the other embodiment of the present invention, as shown in FIG. 4, the flexible wire 11 is corrugated, or in the form of a wave.

According to the adaptor device of the present invention, the extendible force or compressive force generated due to the differences between the sleeve 7 of the adaptor device 2 and the lead wire 4 in the rate of thermal expansion can be absorbed by the flexible wire 11.

Further, any stress generated by the twist etc. of the lead wire 4 when it is assembled into the adaptor device can be prevented from being concentrated on the tip end of the heater wire 3, so that the tip end of the heater wire 3 in the adaptor device can be prevented from being broken.

While the invention has been particularly shown and described with reference to the preferred embodiments thereof, it will be understood by those skilled in the art that various changes in form and details may be made therein without departing from the sprit and scope of the invention as defined by the appended claims.

What is claimed is:

1. An adaptor device for connecting a sheathed heater with a power supply terminal comprising:

An adaptor sleeve into which an end of a heater wire of the sheathed heater and an end of a lead wire of the power supply terminal are inserted, and a flexible stranded wire in the form of a wave for connecting the ends of the heater wire and the lead wire in the adaptor sleeve.

* * * * *